US008047929B2

(12) United States Patent
Berokoff

(10) Patent No.: US 8,047,929 B2
(45) Date of Patent: Nov. 1, 2011

(54) GOLF CLUB WITH NEAR VERTICAL SHAFT

(76) Inventor: Andrew J. Berokoff, Whittier, CA (US)

( * ) Notice: Subject to any disclaimer, the term of this patent is extended or adjusted under 35 U.S.C. 154(b) by 0 days.

(21) Appl. No.: 12/712,114

(22) Filed: Feb. 24, 2010

(65) Prior Publication Data

US 2011/0207548 A1 Aug. 25, 2011

(51) Int. Cl.
*A63B 53/02* (2006.01)

(52) U.S. Cl. ..... 473/313; 473/314; 473/340

(58) Field of Classification Search ..... 473/314, 473/294–296, 298–299, 305, 324, 282, 313
See application file for complete search history.

(56) References Cited

U.S. PATENT DOCUMENTS 3,062,549 A 11/1962 Duden
D213,838 S 4/1969 McAllister
4,411,429 A * 10/1983 Drew et al. ..... 473/313
4,795,153 A 1/1989 Thomas
6,152,832 A 11/2000 Chandler, III
6,712,720 B2 3/2004 Mogolis
6,723,002 B1 4/2004 Barlow
2002/0098905 A1 7/2002 Riseley
2008/0242435 A1 10/2008 Cho

* cited by examiner

*Primary Examiner* — Stephen L. Blau
(74) *Attorney, Agent, or Firm* — Kenneth L. Green

(57) ABSTRACT

A golf club having a bent hosel. The hosel is approximately five inches long and the bend is approximately centered on the hosel. The hosel is connected to the golf club base to angle toward the golfer. At its middle, or approximately two and one half inches above the golf club base, the hosel is bent away from the golfer to a nearly vertical angle. The shaft of the golf club is connected to the upper portion of the bent hosel causing the shaft to continue at the nearly vertical angle. The novel angling of the hosel and shaft allow an average golfer to consistently hit straighter shots beginning with a putter, but including golf irons and golf woods.

15 Claims, 6 Drawing Sheets

GOLF CLUB WITH NEAR VERTICAL SHAFT

BACKGROUND OF THE INVENTION

The present invention relates to golf clubs and in particular to a golf club with a near vertical shaft allowing a more natural and accurate swing.

Known golf clubs include an often large angular offset between the golf club shaft and head position, pushing the golf club head away from a golfer during a swing. As a result, in order to align the club head with the ground horizontally, the golfer must hold the club with the golf club shaft at a slant relative to the vertical, angling down and away from the golfer. The golfer grasps the top grip portion of the shaft and assumes a stance with the shaft and grip slanted toward the waist, stomach, or chest area and spaced away from the golfer's body between approximately two and twelve inches.

Using known golfing methods, the head of the club is placed forward of the golfer's body and behind the ball position, either on the grass of a putting green or on the grass of a fairway. The golfer stands back from the ball position so that the head of the club is generally placed several inches from the toe of the golfer's shoes, (for example, when using a putter) or up to fifty inches away, (for example, when using a driver). The degree of the shaft's slant depends on the golfer's physical height, on the club the golfer is using, and on how much the golfer extends the arms away from the body. Nevertheless, in most cases and situations, the golf club shaft is slanted considerably down and away from the golfer, whether the golfer leans forward to "face" the ball directly or whether the golfer turns their feet or hips a little to the right or to the left. This preparation and positioning, and procedure to make the back swing and the return swing to hit the ball, is commonly referred to as "addressing the ball."

Further, because the golfer holds the club head away from the body, a small lateral torque perpendicular to the swing is present during the swing. While this torque is small, it nevertheless may interfere with the natural "pendulum" motion of the swing and cause a small angular deflection of the club face which the golfer must compensate for. The small angular error in the club face may result in a large position error in the balls final position.

Therefore, the known methods for addressing the ball do not provide a natural swing for some golfers and a new golf club allowing a different method for addressing the ball and the swing is needed.

BRIEF SUMMARY OF THE INVENTION

The present invention addresses the above and other needs by providing a golf club having a bent hosel. The hosel is approximately five inches long and the bend is approximately centered on the hosel. The hosel is connected to the golf club base to angle toward the golfer. At its middle, or approximately two and one half inches above the golf club base, the hosel is bent away from the golfer to a nearly vertical angle. The shaft of the golf club is connected to the upper portion of the bent hosel causing the shaft continue at the nearly vertical angle. The novel angling of the hosel and shaft allow an average golfer to consistently hit straighter shots beginning with a putter, but including golf irons and golf woods.

In accordance with one aspect of the invention, there is provided a golf club providing a more natural swing. The golf club including a head, a hosel, a shaft, and a grip. The head includes a substantially vertical face for hitting a golf ball and a base configured to reside approximately horizontally when the face hits the ball. The hosel is attached to the head at a point on the left side of the head, when viewed facing the face. The hosel includes a lower portion at a first angle between vertical and sloping upward to the left and an upper portion at a second angle between vertical and sloping upward to the right. The shaft extends up from the upper portion of the hosel at a third angle between vertical and sloping upward to the right. The grip is attached at the top of the shaft. The lower portion of the hosel preferably slopes to the left and the upper portion of the hosel preferably slopes to the right, and the shaft is preferably aligned with the upper portion of the hosel.

In accordance with another aspect of the invention, there is provided a method for a golfer to apply a more natural golf club swing. The method includes: grasping the grip of a golf club, the golf club having a shaft aligned with the grip and attached to a hosel which is attached to a head of the golf club, and swinging the golf club with the head of the golf club passing approximately under the golfer's grasp. The hosel includes an upper portion aligned with and attached to the shaft and sloping upward and towards the golfer, or vertical, and a lower portion attached to a head of the golf club at a point on the head away from the golfer.

In accordance with yet another aspect of the invention, there is provided a more accurate golf club using a short back-swing, such as a quarter-back-swing or a half-back-swing. The present invention applies to putters in particular because putting benefits from greater accuracy more than other phases of golf. However, the present invention may be adapted for a "chipper" and several "short irons," clubs which may be used around the putting green and where accuracy is more important than distance. Further, the present invention may be adapted for any fairway iron where the club is not used to make shots at long distances.

In accordance with still another aspect of the invention, there is provided a golf club not requiring a "great arc" type swing. Although prior-art clubs may make accurate shots, they are compromised to also provide leverage and swing speed. One of several ways to achieve swing speed is by swinging with a great arc. In order to make the great arc feasible, club shafts are constructed to slant away from the golfer. In this way, the club head could be a foot to more than a yard away from the golfer's feet. Having this space from where the golfer stands to where he places the club face behind the ball provides the golfer with the room and freedom to swing his arms and hands in the great arc. This is done in conjunction with a powerful pivot at his hips (including shoulder and back turns), that direct the upper torso toward the intended direction of the ball. The great arc, however, is not necessary for putting or for hitting shots when the golfer is close to the putting green. It is the intention of this novel idea to construct a type of golf club that can be swung without the great arc in order to give the average golfer more consistency in making accurate shots both on the putting green and at the near approach area to a putting green.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
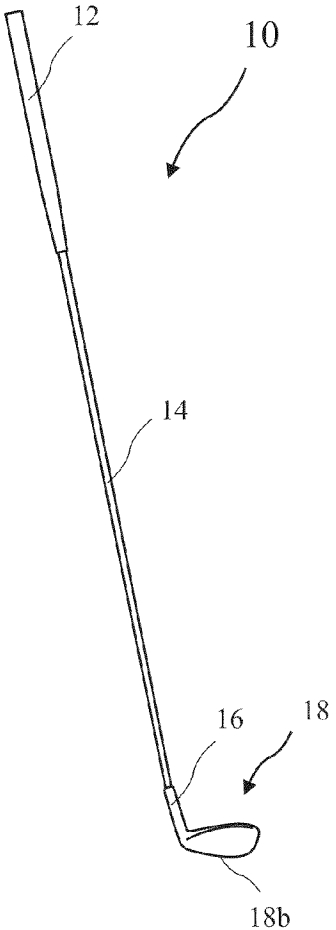
FIG. 1 (prior art)
FIG. 1 is a prior art golf club.

A rear view of a prior art golf club 10 is shown in FIG. 1. The golf club 10 includes a head 18 having a face 18*a* (see FIG. 3) for striking a golf ball, a grip 12 for grasping the club 30, a short hosel 16 attached to the head 18, and a shaft 14 connecting the grip 12 to the hosel 16. At the point of the swing when the face 18*a* of the head 18 strikes the golf ball, the face is substantially vertical but may slope back from the vertical on some clubs to provide some lift to the golf ball, and the base 18*b* of the head is preferably approximately horizontal. The shaft 14 is generally required to be straight for competitive play, and the hosel 16 may be curved but is short and preferably not more than five inches long.

Figure 3:
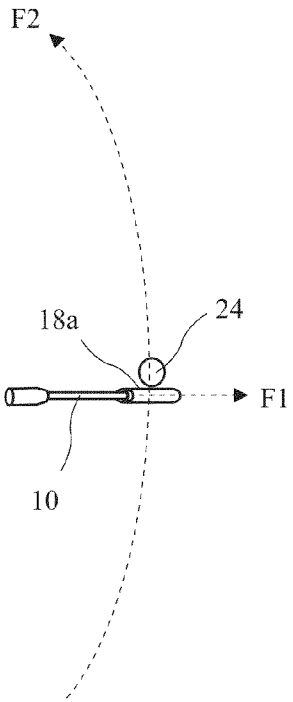
FIG. 3 (prior art)
FIG. 3 shows forces present in a swing of the prior art golf club.
Figure 2:
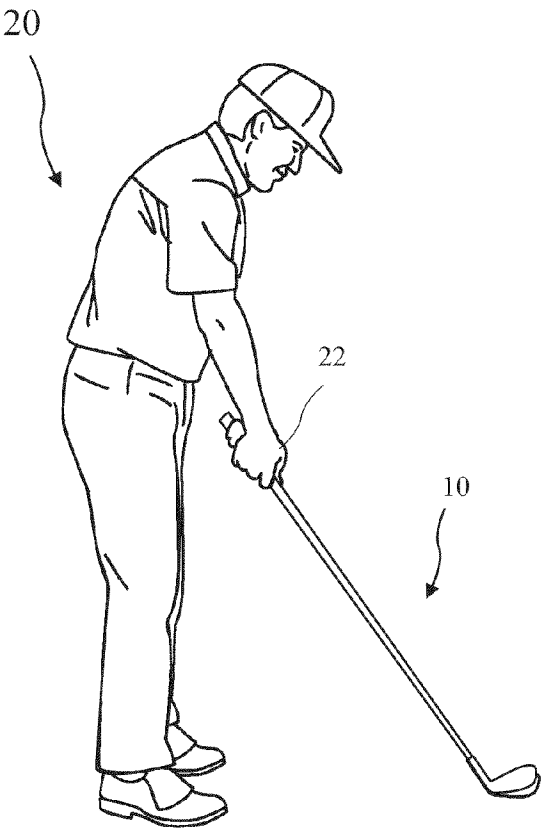
FIG. 2 (prior art)
FIG. 2 shows a golfer holding the prior art golf club.

A golfer 20 is shown holding the prior art golf club 10 in FIG. 2, and forces F1 and F2 present in a swing of the golf club 10 when the club 10 is at a point of making contact with the golf ball 24 are shown in FIG. 3 with the face 18*a* facing up. The golfer 20 exerts a force F2 required for the swing and impact of the face 18*a* of the head 18 with the golf ball 24, but an additional force F1 is required to hold the head 18 of the club away from the golfer 20. Although small, the required force F1 may slightly bias the swing resulting in a slight angling of the face 18*a* of the head 18 and a small variation in the intended trajectory of the golf ball 24. Because the force F1 is not a natural part of the swing, it is difficult for some golfers to learn to properly and consistently swing the prior art golf club 10.

Figure 4:
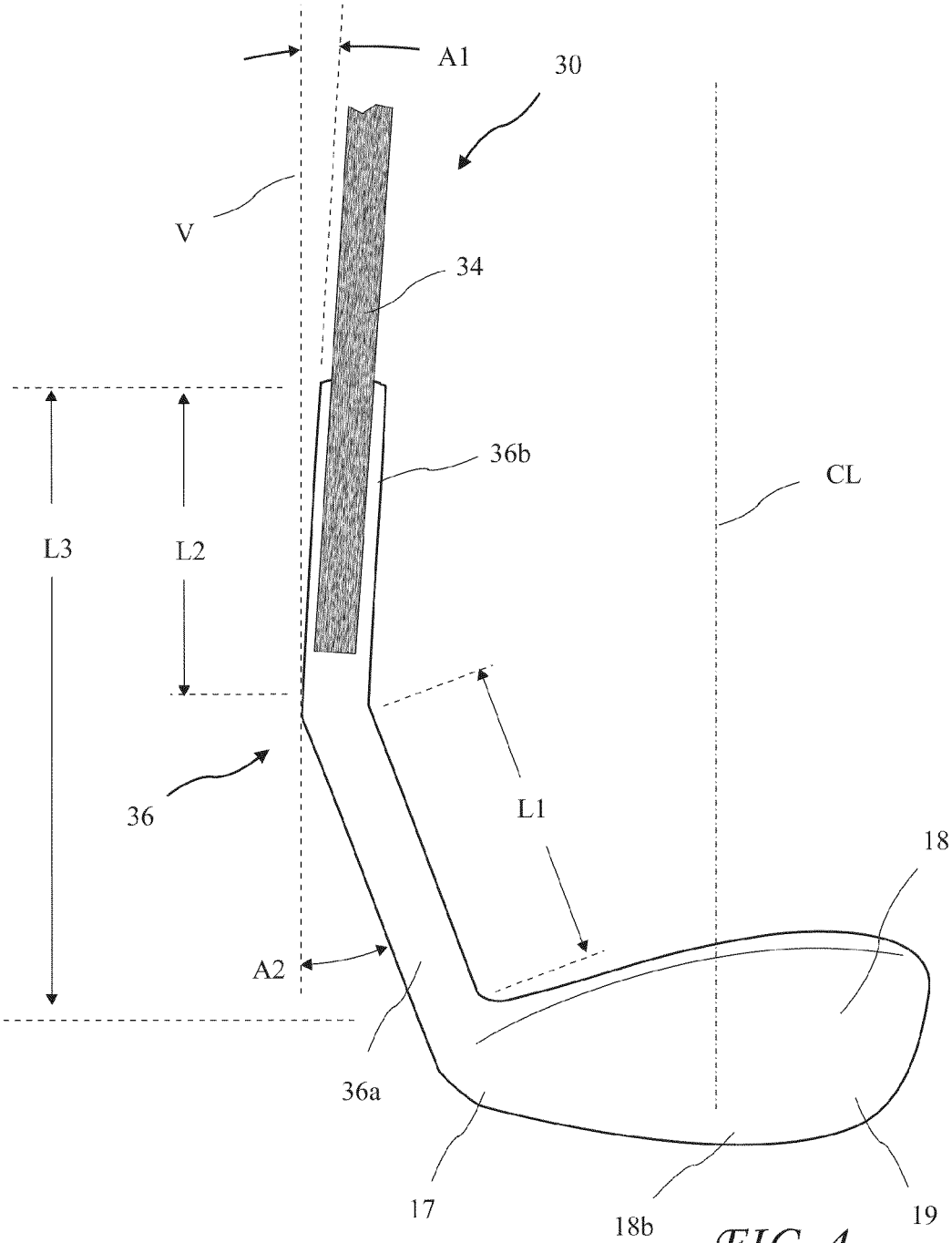
FIG. 4 is a portion of a golf club according to the present invention.

A rear view (i.e., the face of the head of the club into the paper) of the golf club 30 according to the present invention is shown in FIG. 4. The head 18 of the golf club 30 includes a vertical centerline CL horizontally centered on the base 18 and a vertical line V parallel to the centerline CL. The golf club 30 preferably includes a bent (or curved) hosel 36. The shaft 34 extends from the hosel 36 as with the golf club 10, on the left side (or heel 17) of the head 18 when viewed from the rear of the head 18. The hosel 36 includes a lower portion 36*a* and upper portion 36*b*. The lower portion 32*a* is attached to the head 18 near the heel 17, i.e., towards the golfer 20. The lower portion 36*a* preferably is vertical or slopes up and away from the vertical line V and towards the golfer 20, and more preferably slopes away from the vertical line V at an angle A2 from vertical, when the base 18*b* of the head 18 is horizontal. The upper portion 36*b* preferably is vertical or slopes slightly towards the vertical centerline CL, and more preferably slopes slightly towards the vertical centerline CL at a small angle A1 from vertical, when the base 18*b* of the head 18 is approximately horizontal. The angle A1 is preferably approximately three degrees and the angle A2 is preferably approximately 21 degrees. The head 18 further includes a toe 19 opposite the head 17. In use, the heel 17 is the end of the head 18 closest to the golfer 20 and the toe 19 is the end of the head 18 farthest from the golfer 20.

The hosel 36 is preferably connected to the heel 17 of the club head 18 and the lower portion 36*a* points towards the golfer 20 as the golfer 20 normally stands as the golfer addresses the ball 24. The lower portion 36*a* had a length L1 which is preferably between two to three inches and more preferably approximately 2.5 inches. The upper portion 36*b* had a length L2 which is preferably between two to three inches and more preferably approximately 2.5 inches. The overall length L3 of the hosel 36 is preferably not more than five inches and is more preferably five inches. The shaft 34 is attached to the upper portion 36*b* and is aligned with the upper portion 36*b* and resides nearly vertically at the point of impact of the club head 18 with the golf ball 24 during a swing, at which point of impact the base 18*b* of the head 18 is nearly horizontal.

Figure 5:
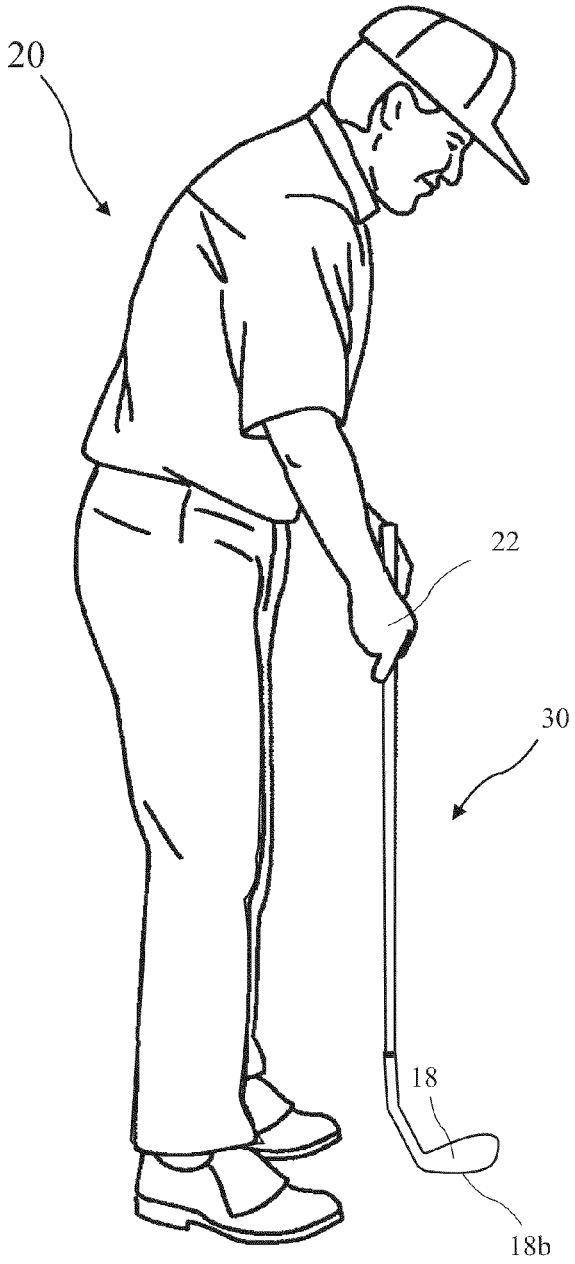
FIG. 5 shows the golfer holding the golf club according to the present invention.

The golfer 20 is shown holding the golf club 30 in FIG. 5. The golfer 20 now holds the grip 12 with the grip 12 and shaft 30 nearly vertical when the base 18*b* of the head 18 is horizontal and the grip 12 at the top of the shaft 12 nearly directly above (i.e., the head 18 of the club 30 is not displaced towards or away from the golfer 20 sufficiently to require any noticeable lateral force F1 (see FIG. 3) to hold the club) on the head 18 at the point of impact and when the base 18*b* of the head 18 of the golf club 30 is nearly horizontal. The grip 12 preferable is at least directly above some portion of the head 18. The golf club 30 provides a vertical or upright shaft at the point of impact with the ball 24 allowing more accuracy than the golf club 10 having a shaft slanted away from the body as shown in FIG. 2. Since leverage and the freedom to create a great arc swing are not essential when using the golf club 30 for making shots that are close to the putting green, the vertical or upright shaft allows the golfer 20 to utilize a more natural and thus more accurate swing.

Figure 6:
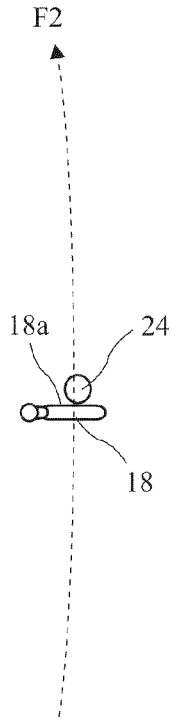
FIG. 6 shows forces present in a swing of the golf club according to the present invention.

The force F2 present in a swing of the golf club 30 is shown in FIG. 6. Because the shaft 30 is now nearly vertical at the point of impact with the ball 24, the head 18 is nearly directly below the grip 12, and the force F1 of FIG. 3 is drastically reduced or eliminated. The golfer 20 is now free to swing the golf club 30 in a more natural manner with improved accuracy.

Figure 7:
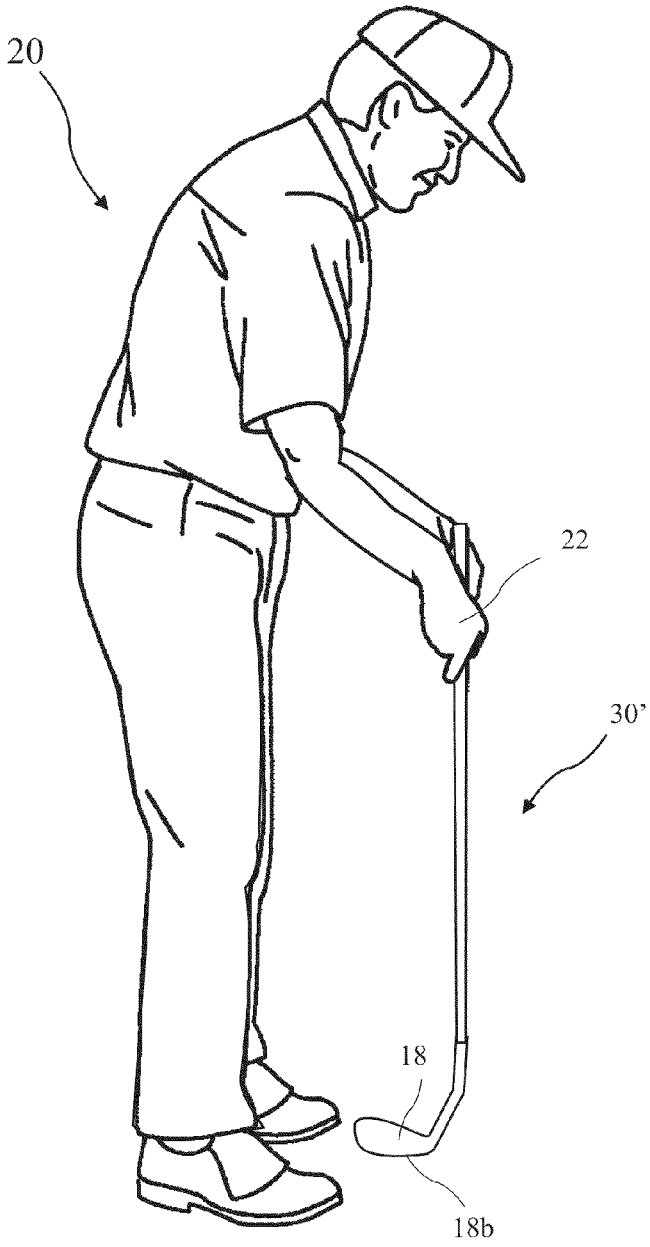
FIG. 7 shows the golfer holding a reverse golf club according to the present invention.
Figure 8:
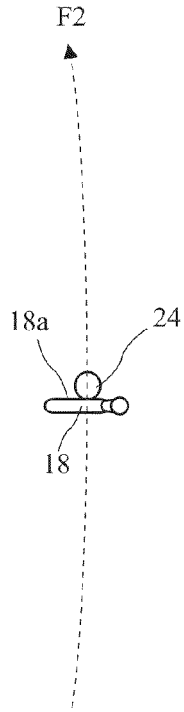
FIG. 8 shows forces present in a swing of the reverse golf club according to the present invention.
Figure 9A:
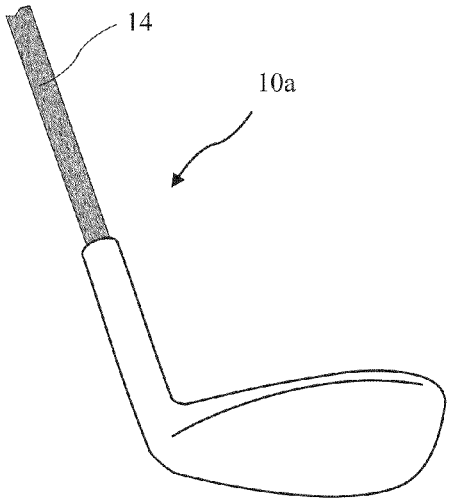
FIG. 9A (prior art)
FIGS. 9A-9D show typical prior art golf clubs.
Figure 9B:
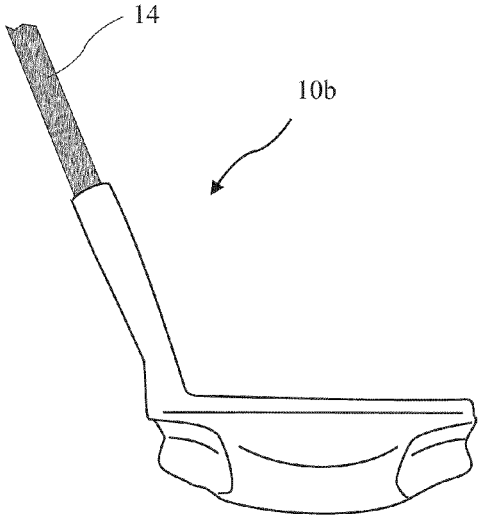
FIG. 9B (prior art)
Figure 9C:
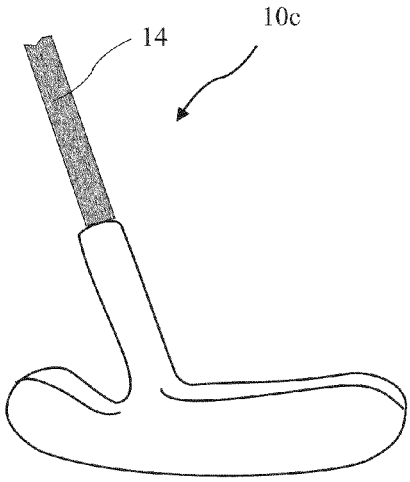
FIG. 9C (prior art)
Figure 9D:
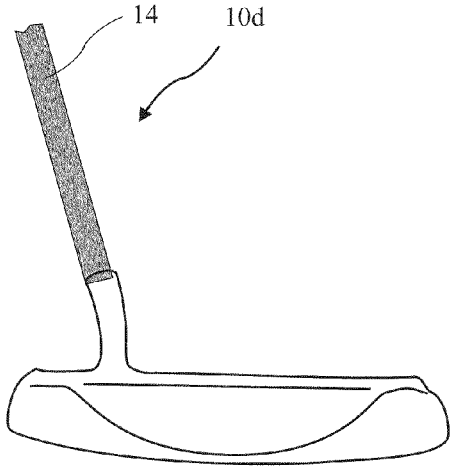
FIG. 9D (prior art)
Figure 10A:
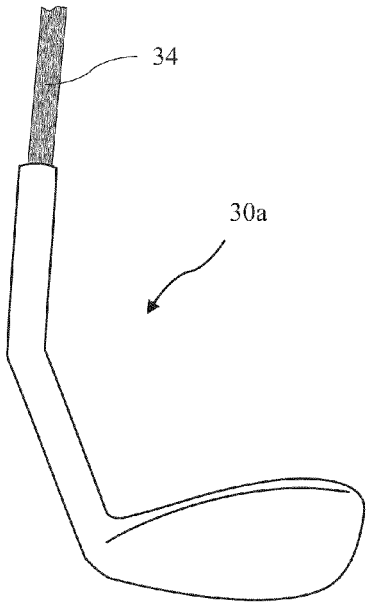
FIGS. 10A-10D show corresponding golf clubs according to the present invention.
Figure 10B:
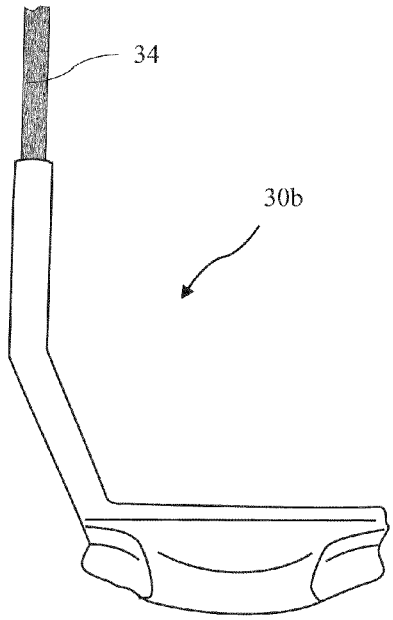
Figure 10C:
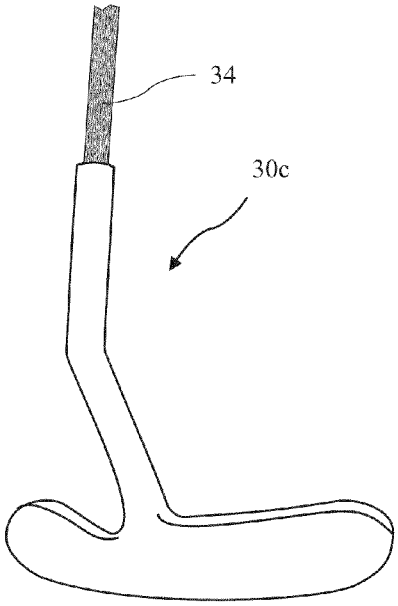
Figure 10D:
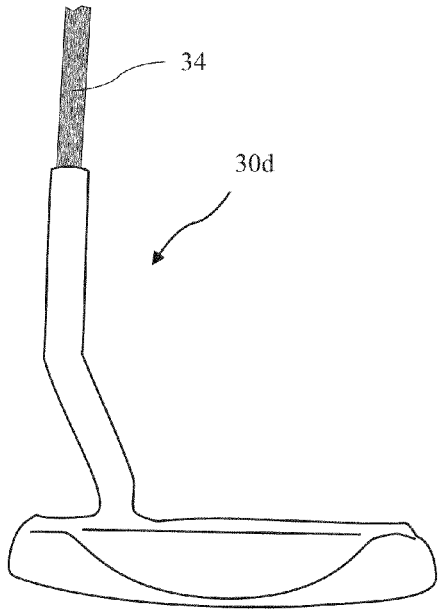

The golfer 20 holding a reverse golf club 30' according to the present invention is shown in FIG. 7 and forces present in a swing of the reverse golf club 30' are shown in FIG. 8. The reverse golf club 30' provides the same advantage as the golf club 30 because head of the club 30' is nearly directly below the grip 12 of the club 30' at the point of impact with the ball 24, thus minimizing or eliminating the lateral force F1 of FIG. 3 freeing the golfer 20 to swing the golf club 30' in a more natural manner with improved accuracy.

Four typical prior art golf clubs 10*a*-10*d* are shown in FIGS. 9A-9D. The golf clubs 10*a*-10*d* all include shafts 14 angled away from vertical upwards and towards the golfer to allow room for a "great arc" type swing. As a result of the angle of the shafts 14, the golfer must compensate for the resulting torque at the grip 12, and errors may be introduced into the flight of the golf ball.

Four golf clubs 30*a*-30*d* according to the present invention corresponding to the prior art golf clubs 10*a*-10*d* are shown in FIGS. 10A-10D. The golf clubs 30*a*-30*d* have nearly vertical shafts reducing or eliminating the torque around the grips 12 of the prior art golf clubs 10*a*-10*d* thereby reducing or eliminating the errors introduced into the flight of the golf ball.

For the putting shot, a right-handed golfer would address the ball in the normal manner with perhaps a couple of exceptions. First, he would place his left leg so that the left shoe is as close to the ball as possible without it being in the way for a putter striking the ball during the performance of his shot. It is important that the golfer pushes the left hand back into his right hand without "breaking" (or bending) his wrists, and maintaining, without "breaking", his wrists to make a solid contact during his return swing and follow through. The golfer should mentally "see" his vertical/upright shaft going directly to the target during its vertical/upright follow-through.

In regards to the "chipper" iron, and the other "irons," it is suggested that until a golfer accustoms himself to this new system, that he should adjust his stance to an "open stance" as follows: assuming he is a right-handed golfer, the golfer puts his right foot toe at or near the place where the ball lies on the fairway grass and opens his stance by placing his left foot to partially spread away toward his left flank, thus creating the "open stance." The open stance may help to prevent "shanking" the ball. The golfer preferably takes his club back with a good pivot and returns the club in his normal manner, but making certain that the vertical/upright shaft is pointing at the target as it is moving through the ball. At about the instant when the two hands are brought down into the ball in the usual manner, the golfer should have in his mind that approximately when the club head makes contact with the ball, that he turns his right hand slightly under his left hand in such a manner that the right forearm feels as if it is coming under the vertical/upright shaft during its movement toward the target. When the follow-through part of the swing is completed, that is to say when the golfer's hands have been extended to almost shoulder level elevation, the golfer might feel that his right forearm is underneath the shaft guiding it as it is finishes its movement aimed at the target. This final maneuver with this new type of hosel/shaft combination may help the golfer to achieve accuracy when the golfer makes his approach shots to the putting green.

While the invention herein disclosed has been described by means of specific embodiments and applications thereof, numerous modifications and variations could be made thereto by those skilled in the art without departing from the scope of the invention set forth in the claims.

I claim:

1. A golf club providing a more natural swing, the golf club comprising:

a head having:

a face for hitting a golf ball;

a vertical centerline residing approximately vertical when the face of club is at a point of contact with the golf ball; and a base configured to reside approximately horizontal when the face of the golf club hits the ball;

a hosel comprising a continuous extension of the head, the hosel comprising:

a lower portion tilting away from the vertical centerline;

an upper portion tilting back over the head at approximately three degrees from the vertical towards the vertical centerline when the base of the head of the golf club is nearly horizontal and the golf club is at the point of contact of the head with the golf ball; and a bend between the lower portion and the upper portion;

a shaft extending from the upper portion of the hosel and approximately aligned with the upper portion of the hosel; and a grip at the top of the shaft, the grip nearly directly above the head when the base of the head of the golf club is nearly horizontal and the golf club is at the point of contact with the golf ball.

2. The golf club of claim 1, wherein: the head has a heel closest to the golfer's shoes at the point of contact of the face of the golf club with the golf ball; and the lower portion of the hosel is attached to the head at a location proximal to the heel.

3. The golf club of claim 1, wherein the lower portion and the upper portion of the hosel are straight.

4. The golf club of claim 1, wherein the head and hosel are formed from a single piece of material.

5. The golf club of claim 1, wherein the shaft extends downward into the upper portion of the hosel ending above the bend between the lower portion and the upper portion of the hosel.

6. The golf club of claim 5, wherein the shaft is straight for the entire length of the shaft.

7. The golf club of claim 1, wherein the shaft extends downward into the upper portion of the hosel ending proximal to the bend between the lower portion and the upper portion of the hosel.

8. The golf club of claim 1, wherein the shaft is straight for the entire length of the shaft.

9. The golf club of claim 8, wherein the shaft tilts back over the head at approximately three degrees from the vertical towards the vertical centerline CL when the base of the head of the golf club is nearly horizontal and the golf club is at the point of contact of the head with the golf ball.

10. The golf club of claim 1, wherein the upper portion and the lower portion of the hosel are between two and three inches in length.

11. The golf club of claim 10, wherein the upper portion and the lower portion of the hosel are about 2.5 inches in length.

12. The golf club of claim 11, wherein the overall length of the hosel is not more than five inches.

13. The golf club of claim 11, wherein the upper portion and the lower portion of the hosel are both straight.

14. The golf club of claim 11, wherein the lower portion of the hosel tilts away from the vertical centerline CL about 21 degrees.

15. A golf club providing a more natural swing, the golf club comprising:

a head having:

a face for hitting a golf ball;

a vertical centerline CL horizontally centered and residing vertically when the face of the golf club is at a point of contact with the golf ball;

a heel closest to the golfer's shoes when the face of the golf club is at the point of contact with the golf ball; and a base configured to reside approximately horizontal when the face of the golf club is at a point of contact with the golf ball;

a hosel formed as a single continuous piece with the head and extending upward from the head at a point proximal to the heel of the head, the hosel having:

a lower portion sloping upward and away from the vertical centerline CL;

an upper portion sloping upward and toward the vertical centerline CL at approximately three degrees from the vertical when the base of the head of the golf club is nearly horizontal and the golf club is at the point of contact of the head with the golf ball; and a bend in the hosel between the lower and upper portions of the hosel;

a shaft extending from the upper portion of the hosel and aligned with the upper portion of the hosel the shaft straight for it's entire length and reaching into the upper portion of the hosel nearly to the bend; and a grip at the top of the shaft and aligned with the shaft, the grip residing approximately vertically above the head when the base of the head of the golf club is nearly horizontal and the face of the golf club is at a point of contact with the golf ball.

* * * * *